US008297575B2

(12) United States Patent
Kluge

(10) Patent No.: US 8,297,575 B2
(45) Date of Patent: Oct. 30, 2012

(54) SHELF SUPPORT BRACKET AND WALL STANDARD

(75) Inventor: Richard G. Kluge, Lake Geneva, WI (US)

(73) Assignee: Knape & Vogt Manufacturing Company, Grand Rapids, MI (US)

( * ) Notice: Subject to any disclaimer, the term of this patent is extended or adjusted under 35 U.S.C. 154(b) by 0 days.

(21) Appl. No.: 13/237,005

(22) Filed: Sep. 20, 2011

(65) Prior Publication Data

US 2012/0006957 A1 Jan. 12, 2012

Related U.S. Application Data

(63) Continuation of application No. 12/386,147, filed on Apr. 14, 2009, now Pat. No. 8,038,112.

(51) Int. Cl.
*A47G 29/12* (2006.01)
*E04G 3/08* (2006.01)
*E06B 7/28* (2006.01)

(52) U.S. Cl. ..... 248/244; 248/235; 248/241; 248/243

(58) Field of Classification Search ..... 248/243, 248/245, 246, 224.51, 224.61, 235, 239
See application file for complete search history.

(56) References Cited

U.S. PATENT DOCUMENTS

| | | | | | |
|---|---|---|---|---|---|
| 391,438 | A | * | 10/1888 | Van Horn | 248/244 |
| 569,640 | A | * | 10/1896 | Hartzell | 248/244 |
| 2,336,604 | A | * | 12/1943 | Edward et al. | 248/243 |
| 2,788,902 | A | | 4/1957 | Nowicki | |
| 2,837,219 | A | * | 6/1958 | Ferdinand et al. | 108/65 |
| 3,865,337 | A | * | 2/1975 | Towfigh et al. | 248/246 |
| 4,342,397 | A | * | 8/1982 | Halstrick | 211/191 |
| 5,074,422 | A | | 12/1991 | Holtz | |
| 5,318,264 | A | | 6/1994 | Meiste | |
| 5,806,820 | A | | 9/1998 | Simon | |
| 6,082,690 | A | * | 7/2000 | Durin et al. | 248/241 |
| 6,109,461 | A | | 8/2000 | Kluge et al. | |
| 7,478,504 | B2 | * | 1/2009 | Huebner et al. | 52/238.1 |
| 8,038,112 | B2 | * | 10/2011 | Kluge | 248/244 |
| 8,042,892 | B2 | * | 10/2011 | Benz et al. | 312/408 |
| 2007/0262220 | A1 | | 11/2007 | Kluge | |

OTHER PUBLICATIONS

Print out from http://issdesigns.com/Standards.htm, p. 1 of 1, as available Mar. 24, 2009.
Print out from http://issdesigns.com/Brackets.htm, p. 1 of 2, as available Mar. 24, 2009.
Print out from http://issdesigns.com/Brackets.htm, p. 2 of 2, as available Mar. 24, 2009.
Print out from http://www.bohnacker-group.com/de/trend-system/fexible-regalsysteme/e-system.html?bra . . . ,p. 1 of 2, as available Mar. 24, 2009.
Print out from https://www.bohnacker-group.com/en/element-system/home-elements/e-system.html, p. 1 of 2, as available Mar. 24, 2009.
Print out from https://www.bohnacker-group.com/en/element-system/home-elements.html, p. 1 of 2, as available Mar. 24, 2009.

* cited by examiner

*Primary Examiner* — Amy J Sterling
(74) *Attorney, Agent, or Firm* — Cook Alex Ltd.

(57) ABSTRACT

A standard and shelf support are provided for supporting one or more shelves at selected elevations from a vertical surface. The standard has a rear wall, and first and second mounting walls being spaced apart and extending from the rear wall. The first and second mounting walls define a channel that is open to the front of the standard. At least one of the first and second mounting walls defines a plurality of spaced apart notches which are not visible from the front of the standard, and the notches are adapted to receive a retention member on a shelf support.

20 Claims, 13 Drawing Sheets

SHELF SUPPORT BRACKET AND WALL STANDARD

CROSS REFERENCE TO RELATED APPLICATION(S)

This application is a continuation of U.S. patent application Ser. No. 12/386,147, which was filed on Apr. 14, 2009, and which is incorporated by reference herein in its entirety.

STATEMENT REGARDING FEDERALLY SPONSORED RESEARCH OR DEVELOPMENT

None.

REFERENCE TO A MICROFICHE APPENDIX

None.

BACKGROUND OF THE INVENTION

1. Technical Field

This invention is directed to an improved shelf support system, and more particularly to a shelf support system that can support one or more shelves at selected elevations on a vertical surface.

2. Technical Problems Posed by the Prior Art

A typical shelving system available in the "do-it-yourself" market uses elongate metal columns, posts, rails, or standards which are adapted to be vertically oriented and fastened to a wall at laterally spaced-apart locations in a parallel array. The vertical standards are typically attached to a wall by screwing the standards into the studs in the wall or by employing drywall anchors and screws to fasten the standard to the drywall anchors embedded in drywall panels that are in turn mounted to the studs. Each standard has a column of vertically spaced slots for receiving the attachment end or connector end of one or more plastic or metal, cantilevered, shelf supports or shelf support brackets. The cantilevered shelf supports are mounted in the slots of the standards at desired levels or elevations along the height of the installed standards. Shelves are placed horizontally across the shelf supports. Some types of shelf supports include holes for receiving screws that are screwed to the undersides of the shelves to securely hold the shelves to the shelf supports. Variations of the above-described conventional shelving system exist. For example, U.S. Pat. No. 6,109,461 illustrates a shelving system in which the vertical standards can be hung from a single support bracket at the top of the wall. The vertical standard illustrated in the U.S. Pat. No. 6,109,461 also has a pair of columns of vertically spaced slots rather than just one column of vertically spaced slots.

While the above-described shelving systems can function satisfactorily in the applications for which they are intended, some people may think that the column or columns of vertically spaced slots in the standards which are exposed and visible above and below each shelf are aesthetically objectionable. Such people might wish to have an improved shelving system in which (1) the visibility of such slots could be minimized relative to an observer looking at the installed shelving system from the front of the shelving system, (2) the shelving system could be easily installed, (3) the shelves could be readily vertically repositioned, and (4) the shelving system would have sufficient strength for the intended loading conditions.

BRIEF SUMMARY OF THE INVENTION

The present invention provides an improved system for mounting one or more shelves in a way that improves the aesthetic display of the components. A preferred embodiment also exhibits good structural strength, is easy to assemble and disassemble, and can be mounted to drywall with drywall anchors in a secure manner that minimizes the likelihood of pulling the anchors out of the drywall.

One preferred embodiment of the invention provides a set of components that can be relatively easily assembled and attached to a wall. In one preferred manner of assembling and installing the system of the invention, wherein a cantilevered shelf support or bracket is connected to a shelf, the installed bracket and connected shelf cannot be moved and repositioned in the shelving system unless and until the shelf is disconnected from the bracket.

According to the present invention, a system is provided for mounting one or more shelves to a generally vertical surface (e.g., wall), and the system includes at least one standard for being attached to the vertical surface. The standard has a rear wall for being attached to the vertical surface. The standard also has a first mounting wall extending from the rear wall, and a second mounting wall extending from the rear wall. The first mounting wall and the second mounting wall are spaced apart to define between them a channel that is open at the front of the standard to provide access to the rear wall. At least one of the first mounting wall and the second mounting wall defines a plurality of vertically spaced notches that are each open at least rearwardly toward the rear wall and that are hidden from view when the standard is viewed directly from the front of the standard.

The system also includes at least one shelf support (e.g., bracket). The shelf support has (a) a shelf support platform upon which at least a portion of a shelf can be disposed, and (b) an attachment portion. The attachment portion (1) is located at one end of the shelf support platform, and (2) can be disposed in the standard channel. The attachment portion has at least one retention member for being received in one of the notches when the shelf support is installed on the standard. The attachment portion has a rear abutment that (a) defines an upper corner, (b) is located rearwardly of the retention member, and (c) can engage the standard rear wall when the shelf support is installed on the standard to position the shelf support platform outwardly of the standard channel in an orientation for supporting the portion of the shelf. The attachment portion has a recess rearwardly of the retention member adjacent the abutment upper corner to allow the shelf support to be pivoted upwardly against the standard rear wall (about a pivot axis defined by the abutment upper corner) and into the recess whereby the retention member is carried rearwardly out of the notch to permit removal or repositioning of the shelf support relative to the standard.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same, FIG. 1 shows the components of the system as assembled, installed on a wall, and supporting one shelf;

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, many of the figures illustrating the invention show a shelving support system in the typical orientation that it would have on a vertically oriented wall, and terms such as upper, lower, horizontal, etc., are used with reference to this position. It will be understood, however, that the components of the shelving support system of this invention may be manufactured, stored, transported, and sold in an orientation other than the position described.

The shelving support system of this invention is suitable for use with a variety of conventional or special shelves. The shelves, per se, form no part of, and therefore are not intended to limit, the present invention.

Figure 1:
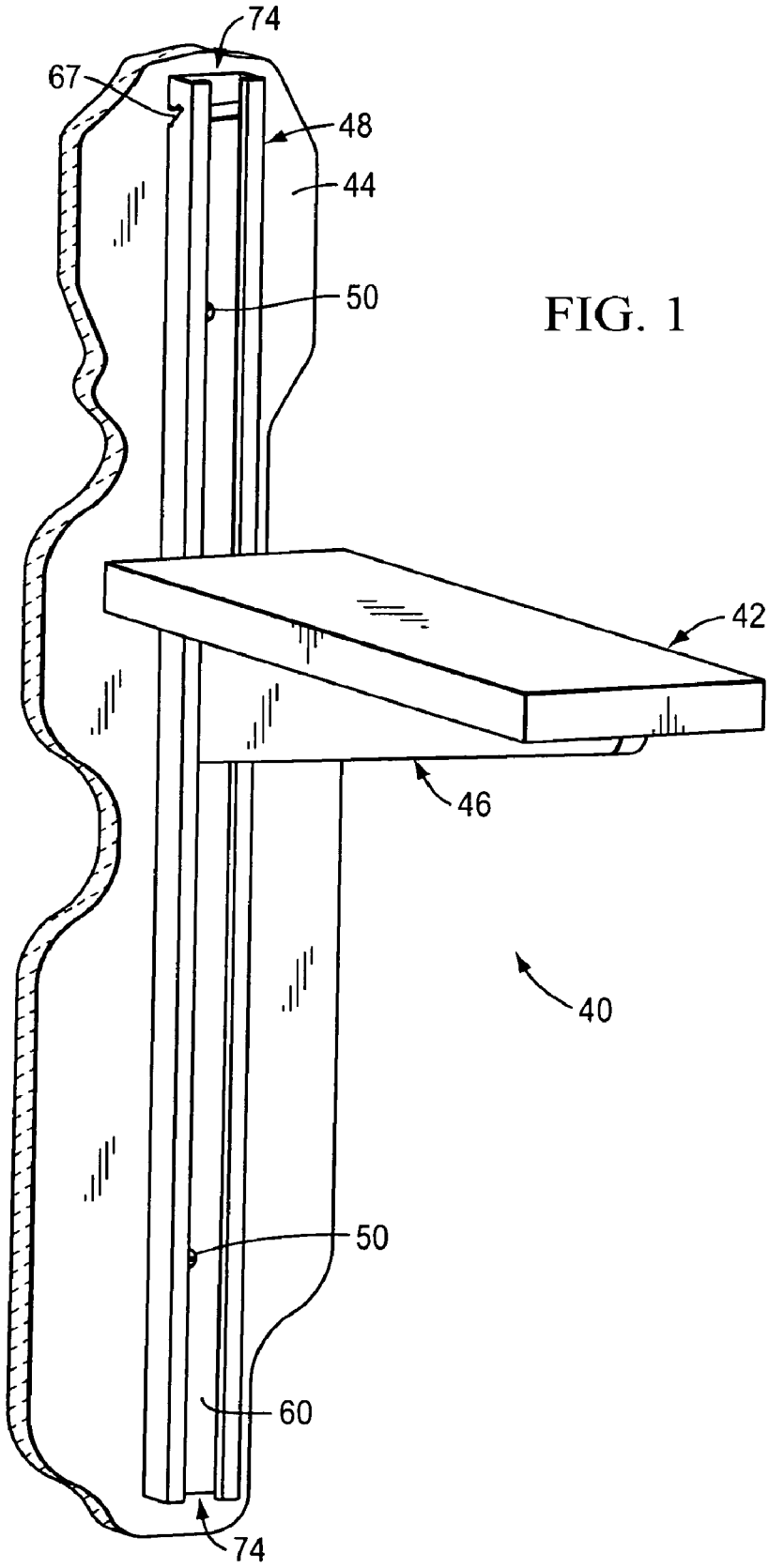
FIG. 1 is a fragmentary, front, isometric view of one preferred embodiment of the system of the present invention for mounting one or more shelves on a vertical surface (e.g., wall) by employing a rail or standard that is attached to the wall and to which a shelf support is mounted.
Figure 2:
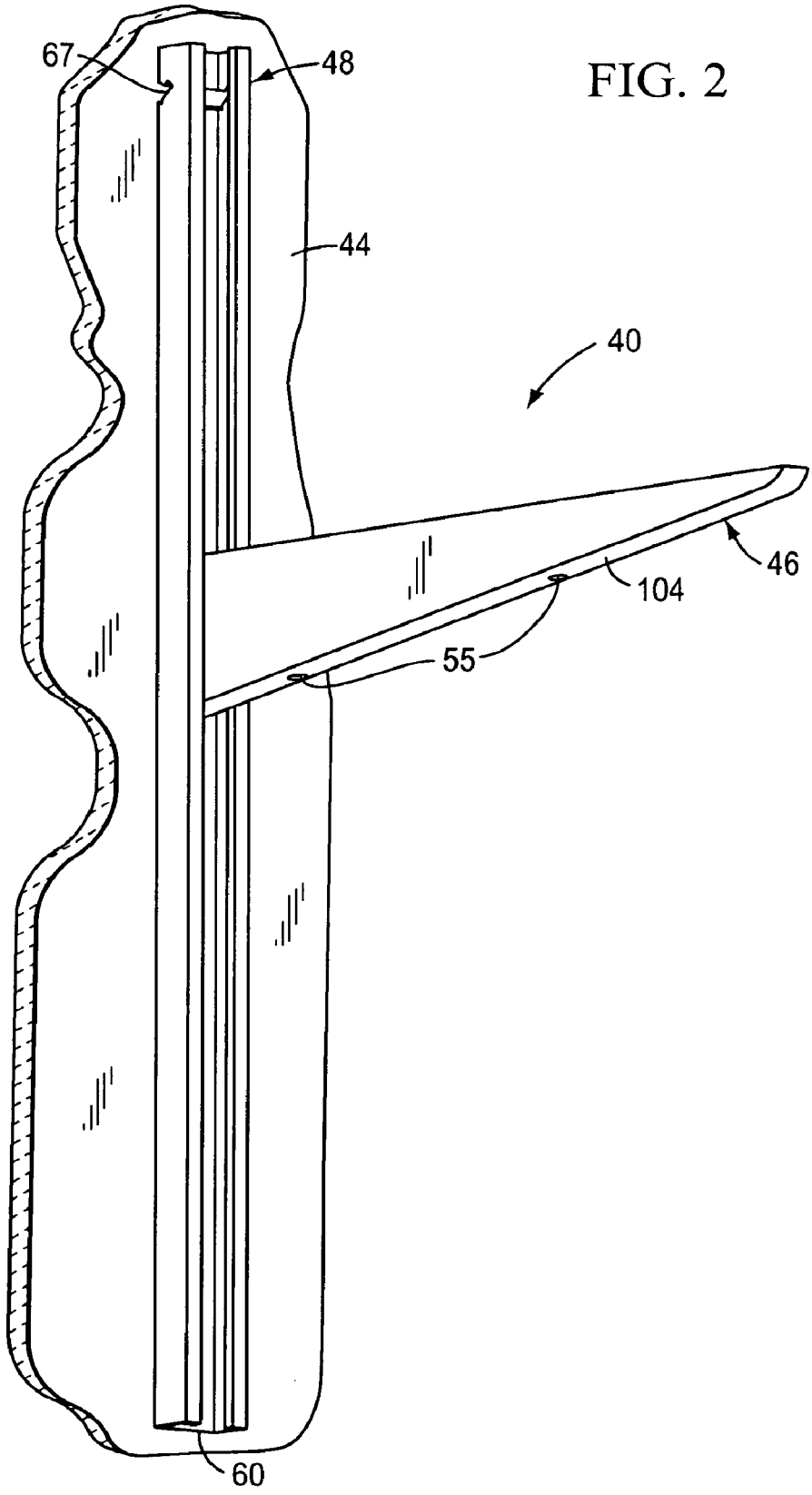
FIG. 2 is an isometric view similar to FIG. 1, but the view in FIG. 2 is looking upwardly from below, and in FIG. 2 the shelf has been omitted.

A presently preferred embodiment of the shelving support system of the present invention is illustrated in FIGS. 1-9 and 10-14, 14A, and 15, and is designated generally therein by the reference number 40 in FIG. 2. The first embodiment of the shelving support system 40 is shown in FIG. 1 supporting a single shelf 42 on a vertical surface 44, such as a drywall panel of a wall. The shelf 42 is supported on a shelf support 46 which is mounted to a single standard 48 that is attached to the vertical surface or wall 44 by means of one or more suitable fasteners, such as the illustrated screws 50 (FIG. 1). The shelf support 46 may also be described as a "shelf bracket," "shelf support bracket," or merely a "bracket." In the following description, and in the claims, the phrase "shelf support" will generally be used for the element 46.

It will be appreciated that in the installation illustrated in FIG. 1, the shelf 42 is a relatively narrow shelf that requires only one shelf support 46. To provide enhanced stability, the shelf 42 may be be screwed to the shelf support 46 where suitable screws 55 (visible only in FIG. 2) which are each positioned with the screw head at the bottom of the shelf support 46 and which each has a threaded shank extending vertically upwardly, through a hole in the support 46, and into the shelf 42.

It will be appreciated that in more typical shelving arrangements, the shelf 42 is normally much wider (longer) so that it would extend horizontally for a greater distance along the wall or other surface 44. With such a typically wider or longer shelf 42, there would be two (or more) standards 48 spaced apart horizontally in a parallel arrangement. At least one separate shelf support would be associated with each vertical standard 48. Further, typically a plurality of shelves 42 would be mounted with shelf supports 46 in a spaced, vertical array upwardly and downwardly on two or more such standards 48.

For ease of illustration, the invention herein is described with reference to the one shelf 42, the one shelf support 46, and the one standard 48. It should be understood that the invention may be practiced with two or more longer shelves that are each supported by two or more shelf supports 46 mounted to two or more standards 48. Where wider (longer) shelves are employed and are disposed across two or more shelf supports 46 mounted to two or more standards 48, it may not be necessary to provide screws 55 for securing the shelves 42 to the shelf supports 46 if it is desired by the user to have a more readily removable shelf.

Figure 3:
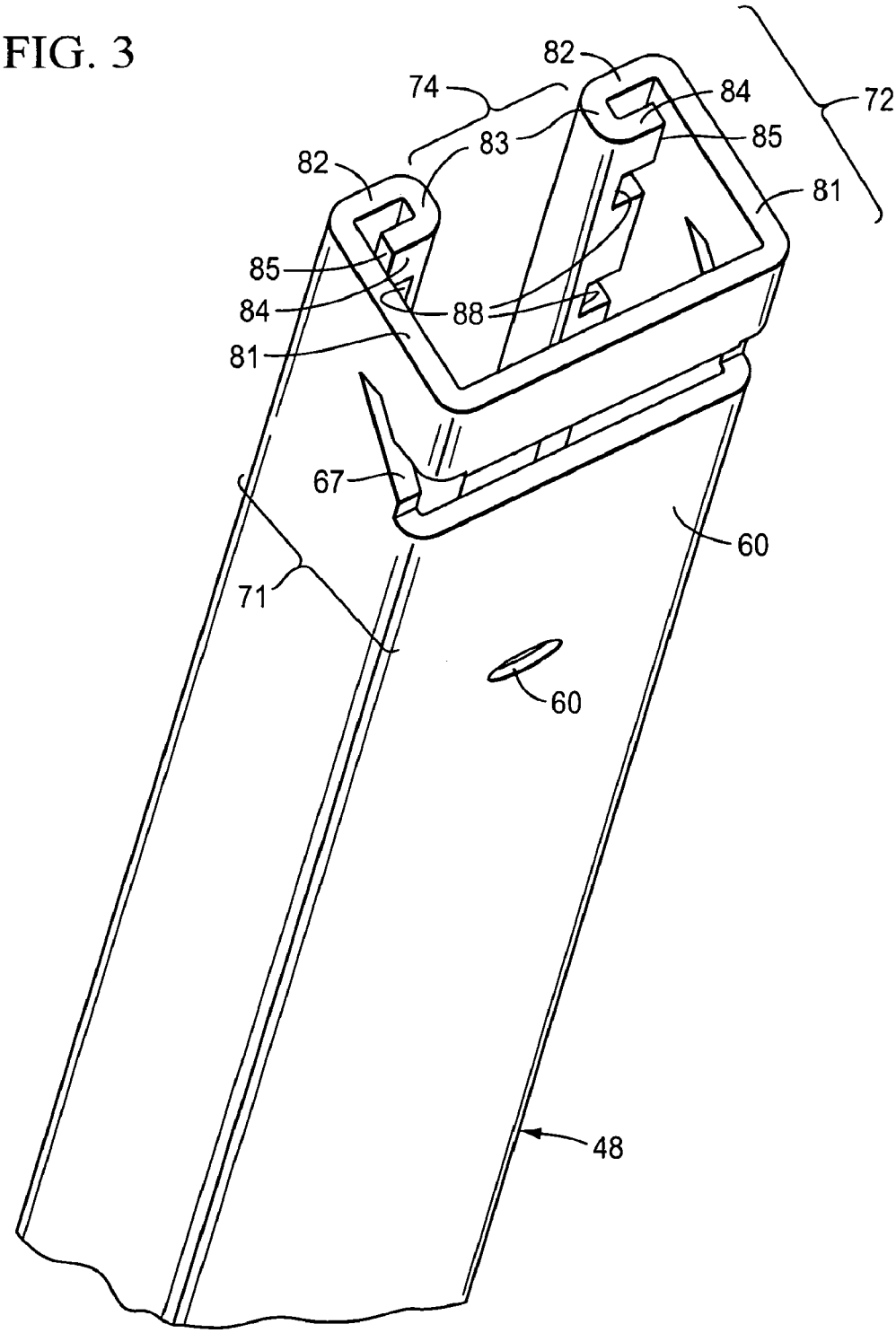
FIG. 3 is a fragmentary, rear, isometric view of the standard employed in the preferred embodiment of the invention illustrated in FIGS. 1 and 2.
Figure 4:
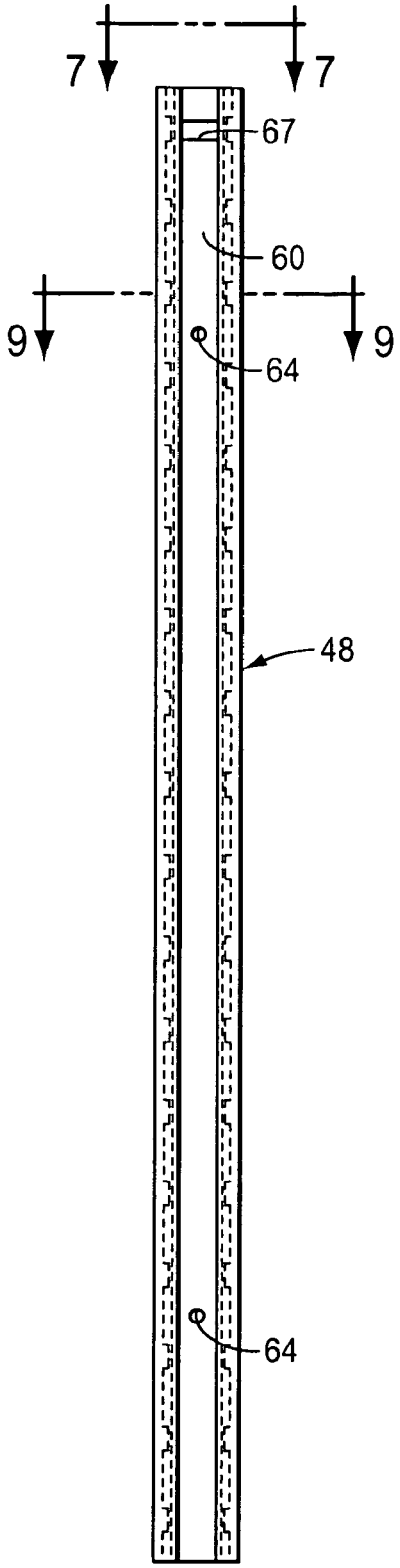
FIG. 4 is a front, elevational view of the standard illustrated in FIGS. 1 and 2.

As can be seen in FIG. 3, the standard 48 has a rear wall 60. As can be seen in FIG. 3, the rear wall 60 of the standard 48 is preferably provided with one or more vertically spaced-apart apertures 64 for each receiving one of the screws 50 (FIG. 1) for attaching the standard 48 to the wall or other vertical surface 44. The screws 50 could be screwed into wall studs (not illustrated) or into drywall anchors embedded in drywall panels that are mounted to such studs.

Figure 5:
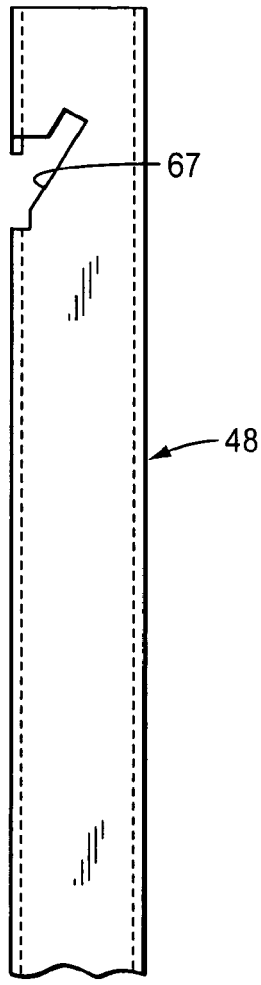
FIG. 5 is a fragmentary, side elevational view of the standard illustrated in FIGS. 1-4.
Figure 6:
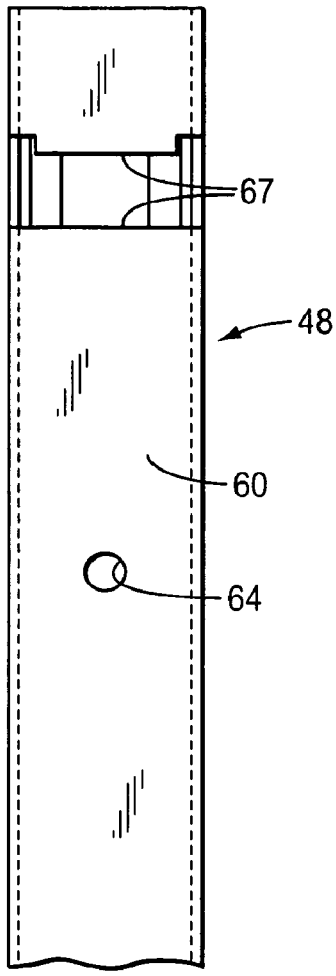
FIG. 6 is a fragmentary, rear elevational view of the standard illustrated in FIGS. 1-5

Instead of using screws 50 in the apertures 64 to attach the standard 48 to the wall 44, or in addition to that manner of attachment, the upper end of the standard 48 can be supported from a horizontal rail (not shown) that is mounted to the wall 48. In particular, FIGS. 3, 5, and 6 show that the upper end of the standard 48B has a slot 67 which is open horizontally at the standard rear wall 60 and which is angled in the sides of the standard 48. A horizontally disposed rail (not illustrated) having an upwardly and outwardly slanted flange could be horizontally mounted to the wall 44, and the standard 48 can be mounted on such a rail with the upwardly angled flange of the rail received in the standard slot 67. If the standard 48 is hung on such a rail received in the standard slot 67 as described above, then, in order to provide greater stability, the lower portions of the standard 48 would typically also be attached to the wall 44 with the screws 50 (FIG. 1) that are received in the standard apertures 64 and that are appropriately secured to the wall 44 (such as to the wall studs or to drywall anchors which are embedded in drywall panels defining the wall 44).

Figure 7:
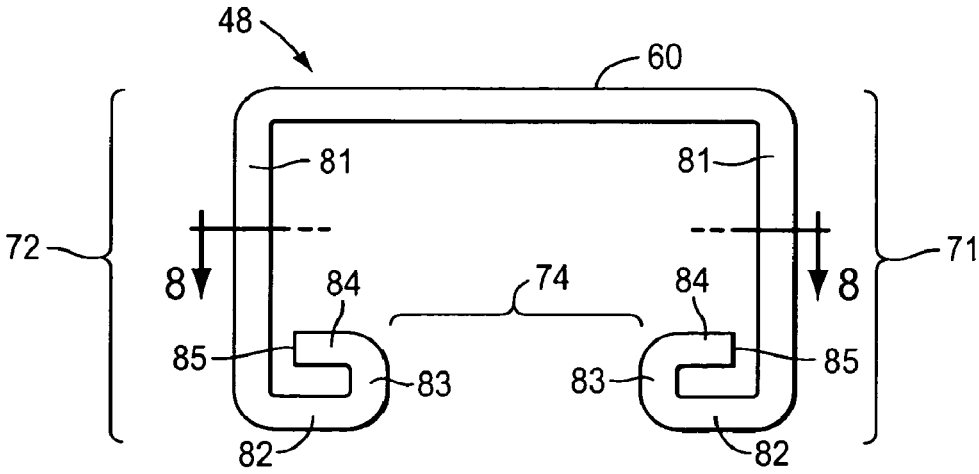
FIG. 7 is an enlarged, top plan view of the standard taken along plane 7-7 in FIG. 4.
Figure 9:
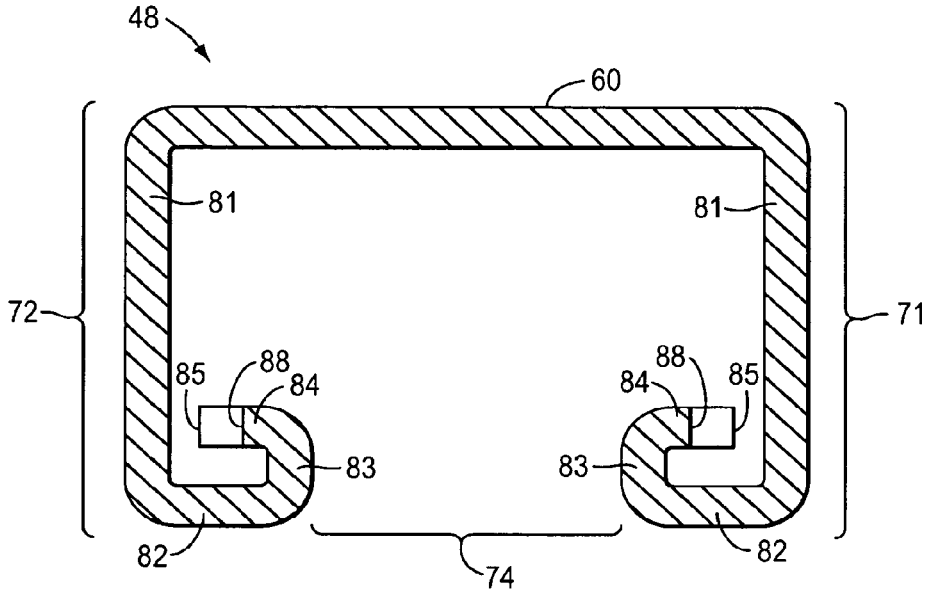
FIG. 9 is an enlarged, cross-sectional view taken generally along the plane 9-9 in FIG. 4.

As can be seen in FIGS. 3, 7 and 9, the standard 48 includes a first mounting wall 71 extending forwardly from the rear wall 60, and the standard 48 also includes a second mounting wall 72 extending forwardly from the rear wall 60. As can be seen in FIGS. 3, 7, and 9, the first mounting wall 71 and second mounting wall 72 are spaced apart to define between them a channel 74 that is open at the front of the standard 48 to provide access to the rear wall 60. In the preferred embodiment illustrated in the figures, the channel 74 has an open bottom end and an open top end (wherein the "bottom end" and "top end" are defined when the standard 48 is attached vertically to a vertical surface, such as the surface 44 illustrated in FIG. 1), and the channel 74 extends along the entire standard 48 (wherein the "length" of the standard 48 equals the "height" of the standard 48 as measured from the bottom end to the top end).

As can be seen in FIG. 7, the presently preferred form of each mounting wall 71 and 72 has (1) a first portion 81 extending perpendicularly from the rear wall, (2) a second portion 82 extending perpendicularly from the first portion 81 and oriented parallel to the rear wall 60, (3) a third portion 83 extending perpendicularly from the second portion 82 and oriented parallel to the first portion 81, and (4) a fourth portion 84 that (a) extends perpendicularly from the third portion 83, (b) is oriented parallel to both the second portion 82 and the rear wall 60, and (c) terminates in a free vertical edge 85 which is spaced from the adjacent first portion 81.

Figure 8:
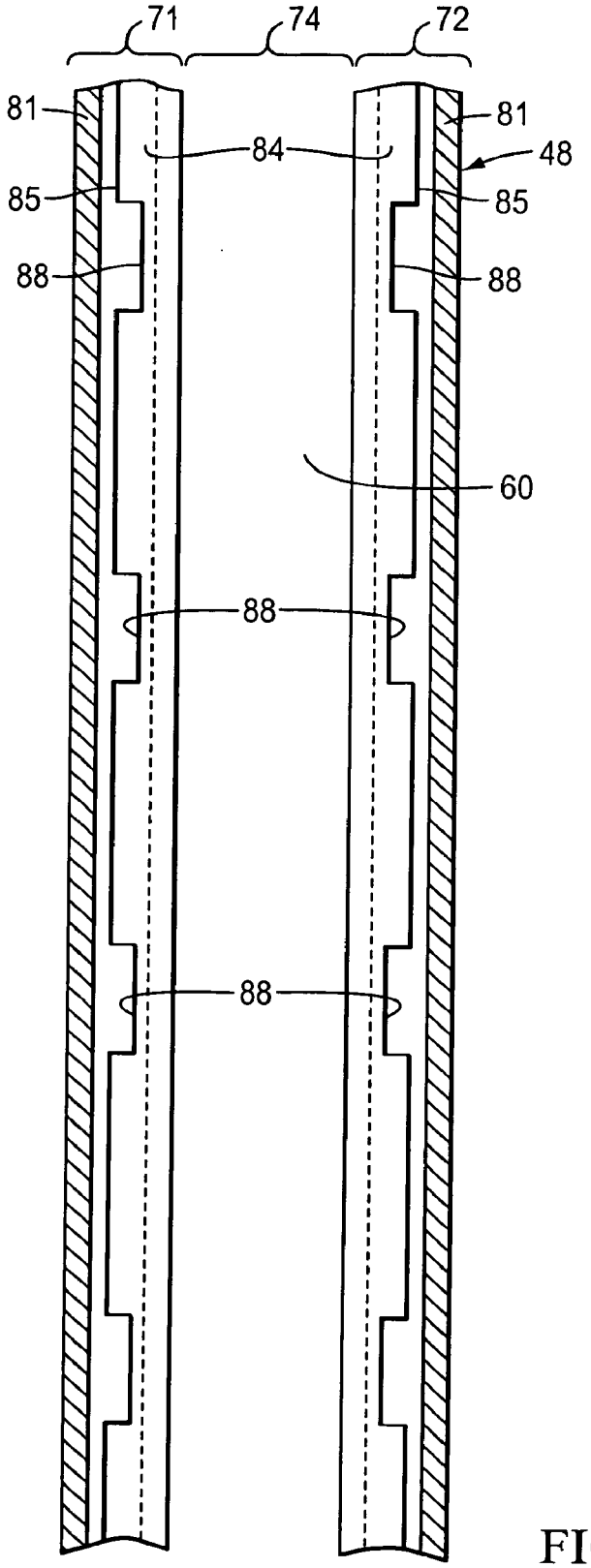
FIG. 8 is a reduced size, fragmentary, cross-sectional view taken along the plane 8-8 in FIG. 7.

With reference to FIGS. 3, 8, and 9, the fourth portion 84 of each mounting wall 71 and 72 defines recesses, slots, or notches 88 along the free vertical edge 85. In the preferred embodiment illustrated, each notch 88 extends completely through the fourth portion 84 from front to rear (i.e., with reference to FIG. 9, the rear of each notch 88 is open to the standard rear wall 60, and the front of each slot 88 is open to the second portion 82 of the mounting wall which defines a front surface portion of the standard 48).

Figure 9A:
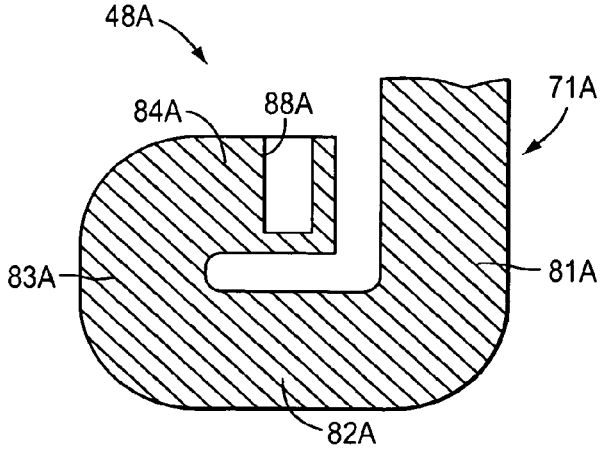
FIG. 9A is a greatly enlarged, fragmentary, cross-sectional view similar to FIG. 9, but FIG. 9A shows a modified form of a portion of the standard of the system of the present invention.

However, it is not required that the notches 88 each be open all the way through the fourth portion 84 of the mounting wall from the rear to the front. It is sufficient that each notch 88 is open rearwardly at least toward the standard rear wall 60, but each notch 88 may be closed on the front. As an example of such an alternative, FIG. 9A illustrates a modified form of a standard 48A having mounting walls (e.g., mounting wall 71A) illustrated with relatively thick first portions 81A, second portions 82A, third portions 83A, and fourth portions 84A, and wherein each notch 88A extends only partway into the fourth portion 84A from the rear of the standard 48A and does not extend completely through the fourth portion 84A. The minimum horizontal extent or depth of each notch 88A depends on the size and shape of a retention member that is part of the shelf support as described in detail hereinafter. In FIG. 9A, the notch 88A is also not open laterally to the mounting wall first portion 81A, but rather, is closed off at the free edge of the mounting wall fourth portion 84A. The width of each notch 88A also depends upon the size and shape of such shelf support retention members described in detail hereinafter.

Figure 9B:
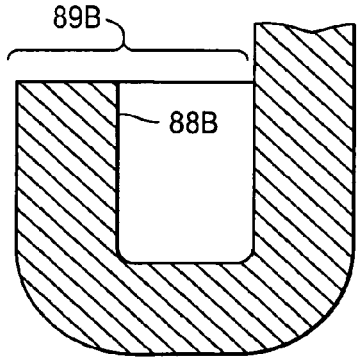
FIG. 9B is a greatly enlarged, fragmentary, cross-sectional view similar to FIG. 9, but FIG. 9B shows yet another modified form of the standard of the system of the present invention.

The preferred form of standard mounting wall portions 81, 82, 83, and 84 shown in FIG. 9 could also be alternatively modified as shown in FIG. 9B wherein each side of the front of the standard has just one thick flange 89B defining vertically spaced notches 88B.

Now with reference to the preferred embodiment of the standard 48 illustrated in FIG. 8, it can be seen that each notch 88 is defined along the free, vertical edge 85 of the mounting wall fourth portion 84, and extends completely through the fourth portion 84. The fourth portion 84 has generally planar surfaces that define the top, bottom, and vertical side of each notch 88. Each notch 88 is a generally rectangular shape notch which is open both rearwardly, forwardly, and laterally (i.e., to the side in the direction of the mounting wall first portion 81). In the preferred embodiment illustrated in FIG. 8, the notches 88 (which are defined in the fourth portions 84 of the first mounting wall 71 and second mounting wall 72) are aligned in horizontal registration or alignment when the standard 48 is vertically oriented (as the standard 48 would typically be installed on a wall or other vertical support surface 44). An alternative design (not illustrated) wherein the notches need not be in horizontal registration or alignment is discussed hereinafter.

In a presently preferred form of the standard 48, the standard 48 is made from steel sheet or plate, such as 0.048 inch thick, cold rolled steel, which is cut, notched, and bent into the desired configuration. The structure of the standard 48 provides good strength and rigidity.

It will be understood, however, that the standard 48 may be made from materials other than metal. For example, the standard 48 could be extruded or molded from a suitable thermoplastic material for use in light load shelving systems.

Figure 13:
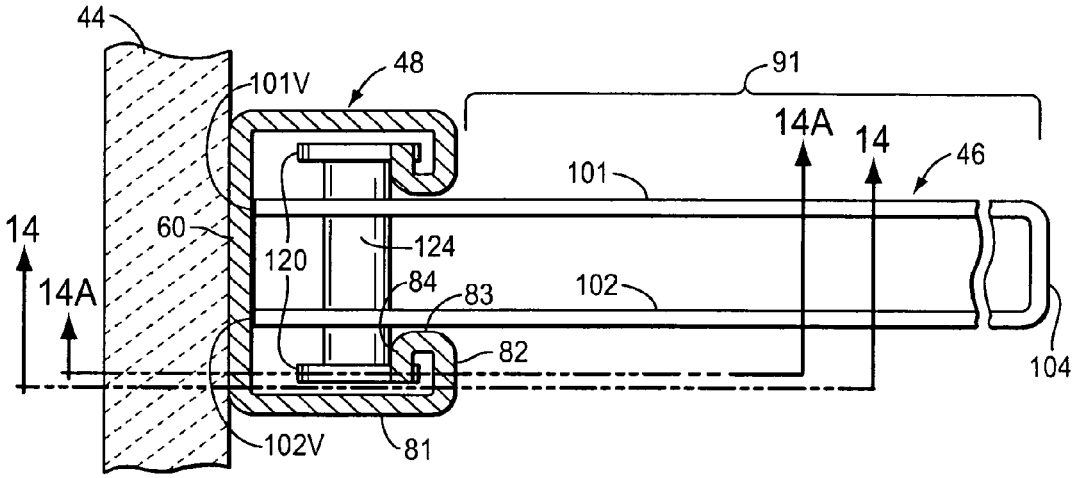
FIG. 13 is a greatly enlarged, fragmentary, cross-sectional view taken generally along the plane 13-13 in FIG. 12.
Figure 14:
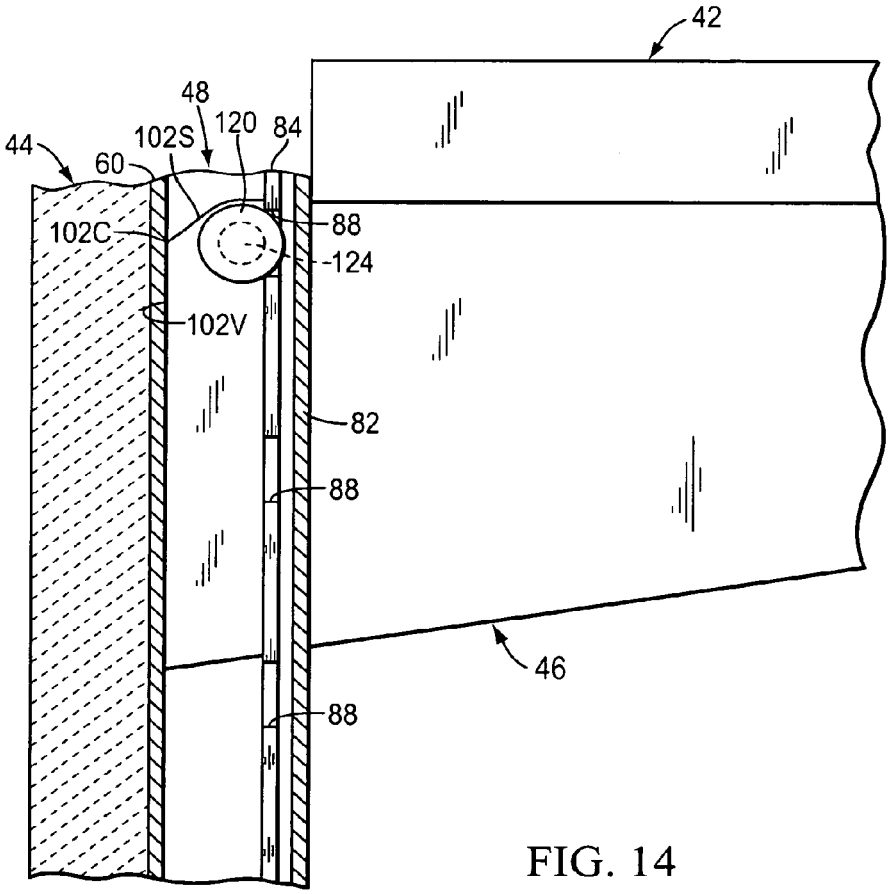
FIG. 14 is a fragmentary, cross-sectional view taken generally along the plane 14-14 in FIG. 13.

The standard 48 offers advantages with respect to wall mounting compared to other, conventional standards that have an open channel configuration facing rearwardly toward a wall or other support surface, instead of facing forwardly as in the standard 48 of the present invention. With the standard 48 of the present invention, the standard rear wall 60 can preferably be provided in a flat, or planar, form (as illustrated in FIGS. 1, 13, and 14) so that such a flat configuration of the rear wall 60 lies flat against the vertical surface 44. Then when the standard 48 is secured to the vertical surface 44 with screws or other fasteners (e.g., screws 50 in FIG. 1), the rear wall 60 is trapped between the head of the screw 50 and the vertical surface 44 to provide a large bearing surface. The wall or other vertical surface 44 lies in surface-to-surface contact with the rearwardly facing surface of the standard rear wall 60.

In contrast, with other, conventional standards that have a rearwardly facing channel open against the wall or other vertical surface (e.g., surface 44 in FIG. 1), a screw that attaches such a conventional standard to the vertical surface or wall may pull and deform a portion of the vertical wall (e.g., a drywall panel) outwardly to bow into the rearwardly opening channel of such a conventional standard, and this may adversely affect the integrity of the attachment. Further, when such a conventional standard with a rearwardly opening channel is mounted to a typical drywall panel with drywall anchors, the tightening of the mounting screws from the front of the conventional standard may tend to pull the drywall anchor out of the drywall into the hollow channel of the conventional standard. In contrast, with the standard 48 of the present invention, when the standard rear wall 60 is in surface-to-surface contact with a drywall panel, the tightening of a mounting screw from the inside of the forwardly facing channel of the standard merely snugs the drywall anchor up against the rear surface of the rear wall 60 of the standard 48, and this cooperates to tighten the clinching or securement of the drywall anchor.

When the standard 48 is initially, properly mounted on a vertical support surface, such as the support surface 44 illustrated in FIGS. 1 and 2, the notches 88 are not visible to a person who is standing in front of the standard 48 and looking at the standard 48. Because the notches 88 are not visible from the front of the standard 48, the standard 48 provides a more sleek, aesthetically pleasing design.

Figure 10:
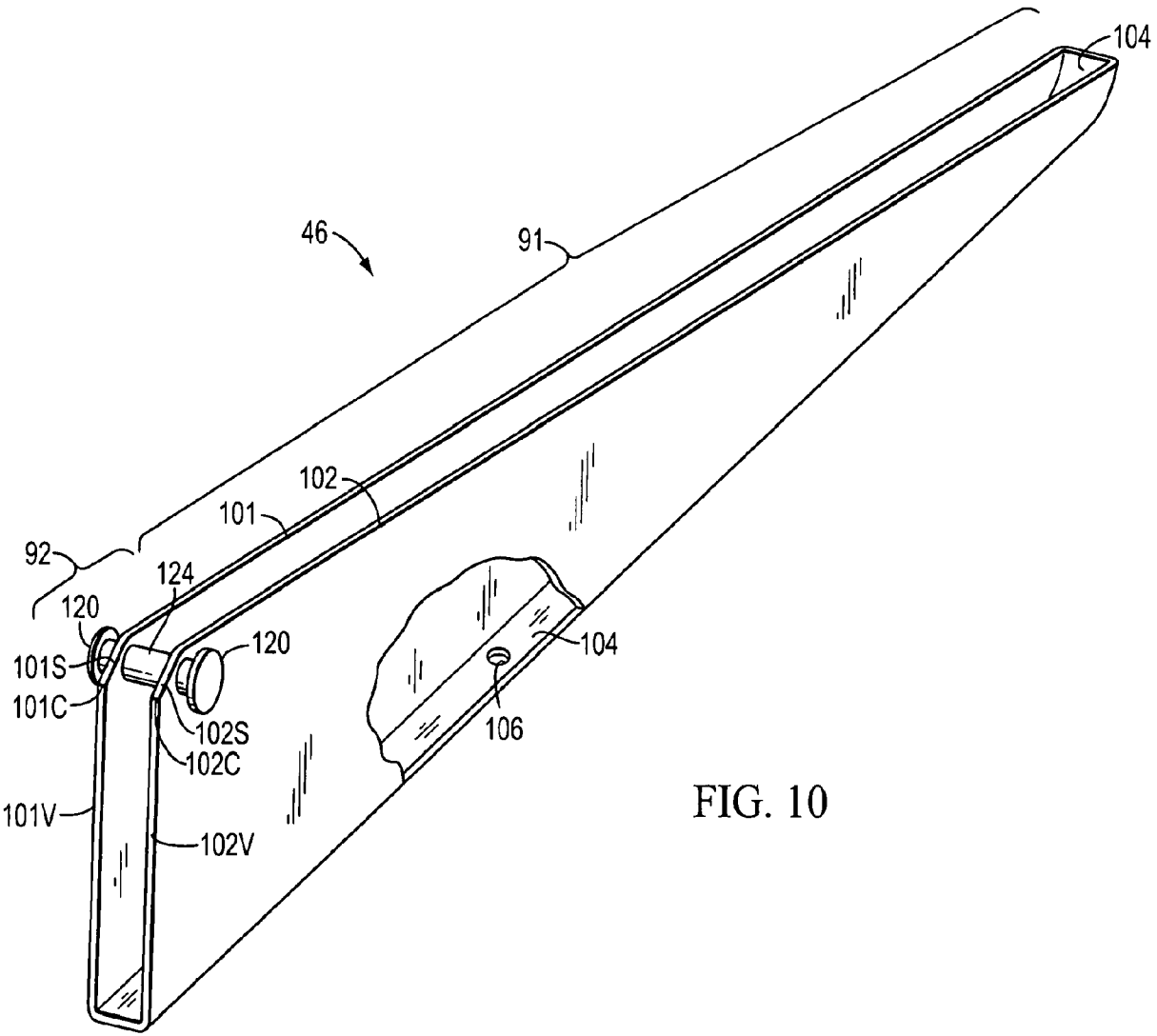
FIG. 10 is a greatly enlarged, rear, isometric view of the shelf support shown in FIGS. 1 and 2.
Figure 11:
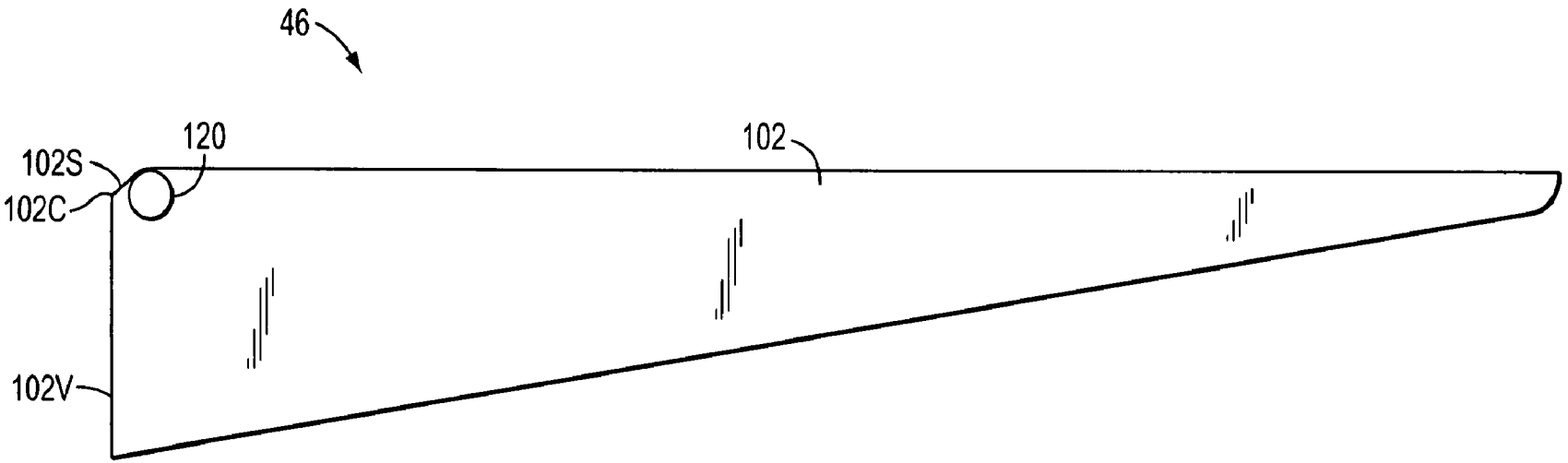
FIG. 11 is a side elevational view of the shelf support shown in FIG. 10.
Figure 12:
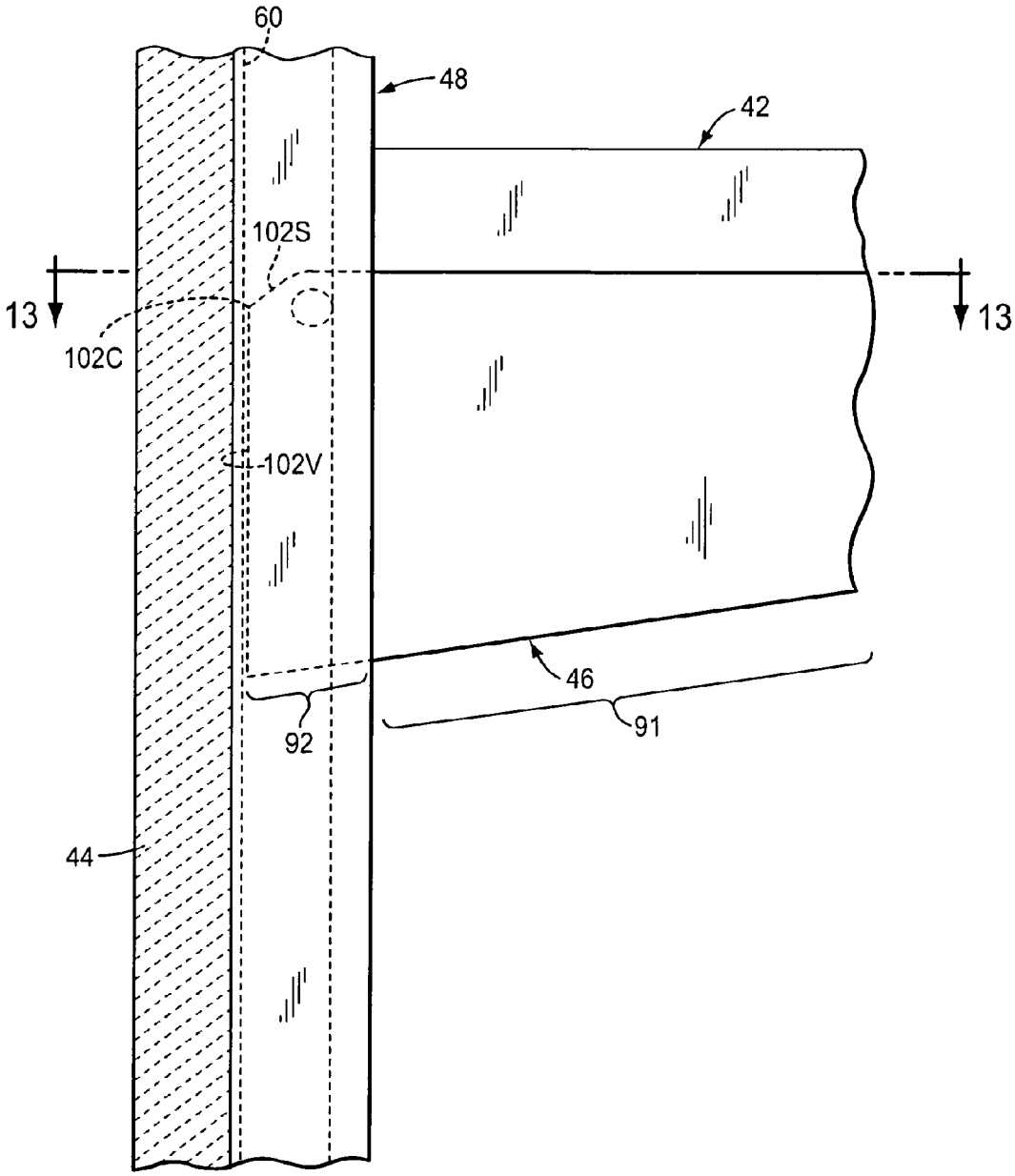
FIG. 12 is a fragmentary, side elevational view of the system illustrated in FIG. 1, and in FIG. 12 the wall is shown in cross section.

As can be seen in FIGS. 3, 10, and 12, the shelf bracket or shelf support 46 can be characterized as having two portions—a shelf support platform 91, and an attachment portion 92. The shelf support platform 91, in the preferred embodiment illustrated in FIG. 10, has a generally U-shaped, transverse cross section defined by (1) a first leg 101, (2) a second leg 102 which is spaced from, and generally parallel, to the first leg 101, and (3) a connecting web 104 which runs down the front, and along the length of the bottom, of the shelf support platform 91. The web 104 along the bottom of the shelf support platform 91 defines one or more apertures 106 (FIG. 10) for receiving the shanks of the screws (e.g., screws 55 illustrated in FIG. 2) that may optionally be used to screw into the bottom of the shelf 42 (FIG. 2) for holding the shelf 42 to the top horizontal edges of the legs 101 and 102.

The horizontal, upper edges of each leg 101 and 102 may be characterized as defining support surfaces of the platform 91 for receiving and supporting a portion of a shelf 42. The platform 91 could have other suitable configurations for supporting the bottom of a shelf 42.

As can be seen in FIG. 10, the shelf support attachment portion 92 is located at the rear end of the shelf support platform 91. As illustrated in FIG. 10, in the preferred embodiment, the shelf support platform first leg 101 and second leg 102 extend rearwardly to define the attachment portion 92.

Figure 14A:
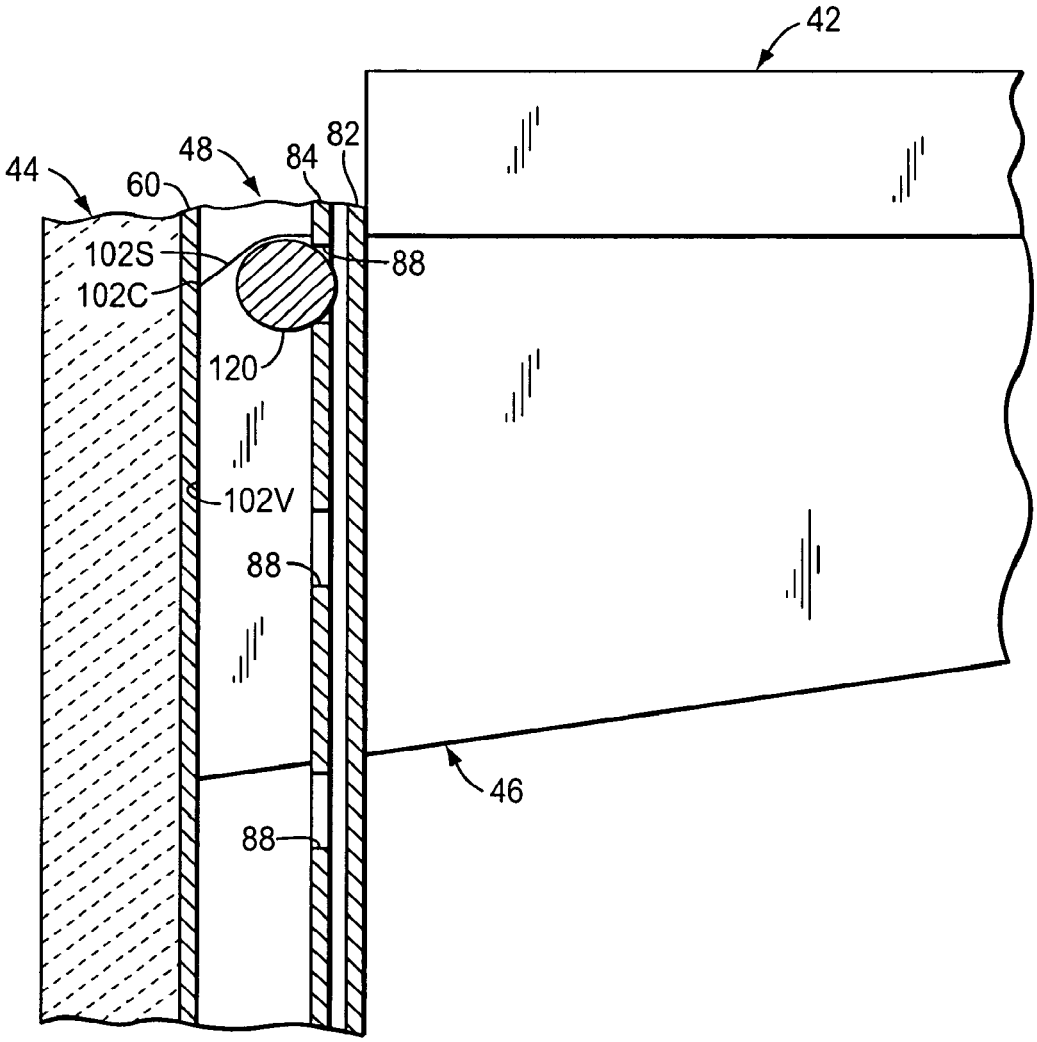
FIG. 14A is a fragmentary, cross-sectional view taken generally along the plane 14A-14A in FIG. 13.

In the shelf support attachment portion 92, each leg 101 and 102 defines a vertical rear edge 101V and 102V (FIG. 10) for engaging the front surface of the standard rear wall 60 when the shelf support 46 is attached to the standard 48 as can be seen in FIGS. 14 and 14A.

With reference to FIG. 10, and as can be seen in FIG. 12, the rear portion or attachment portion 92 of the shelf support 46 is adapted to be disposed within the channel of the standard 48. The shelf support attachment portion 92 includes a pair of spaced-apart, retention members 120 for each being received partially within a respective one of the notches 88 of the standard 46 as can be seen in FIGS. 13 and 14. In the preferred embodiment illustrated, the two retention members 120 are also horizontally aligned, and each retention member 120 is a disc having a generally flat, cylindrical configuration. Each retention member 120 is mounted at opposite ends of an intermediate shank 124 (FIGS. 10 and 13). In a presently preferred embodiment, a type of conventional rivet may be employed as a unitary body that (1) has two oppositely projecting rivet heads defining the retention members 120, and (2) has a reduced diameter, generally cylindrical connecting member defining the shank 124. With reference to FIG. 10, the shank 124 is generally horizontally mounted through a receiving aperture in the shelf support first leg 101 and through a receiving aperture in the shelf support second leg 102. The shank 124 may be fixed in the desired position in the shelf support member 46 by means of a press fit, by means of staking, or by other suitable conventional or special means, the details of which form no part of the present invention.

With reference to FIG. 10, the upper end of the rear vertical edge 101V of the shelf support first leg 101 defines an upper corner 101C. Similarly, with continued reference to FIG. 10, the upper end of the vertical edge 102V of the shelf support second leg 102 defines an upper corner 102C. Each corner 101C and 102C and each vertical edge 101V and 102V is located rearwardly of the retention members 120. At least the lower ends of the rear vertical edges 111V and 102V can engage the standard rear wall 60 when the shelf is installed on the standard 48 to position the shelf support platform 91 outwardly of the channel of the standard 48 in an orientation for supporting the shelf 42 (FIGS. 13 and 14). Each rear vertical edge 101V and 102V of the shelf support legs 101 and 102, respectively, may be regarded separately or together as a "rear abutment" that (a) can engage the standard rear wall 60 when the shelf support 46 is installed on the standard 48, and (b) defines the respective upper corner (corner 101C or corner 102C), and (c) is located reawardly of the retention members 120.

With further reference to FIG. 10, the shelf support attachment portion 91 also defines a recess rearwardly of the retention members 120 adjacent the upper abutment corners 101C and 102C. In the preferred embodiment illustrated in FIG. 10, the recess is defined at least in part by a slanting surface 101S that extends from the corner 101C at an acute angle relative to the standard rear wall 60 as measured when the shelf support 46 is installed on the standard 48. Similarly, in the preferred embodiment illustrated in FIG. 10, the recess in the shelf support attachment portion 92 is also defined at least in part by a slanting surface 102S extending from the corner 102C at an acute angle relative to the standard rear wall 60 as measured when the shelf support 46 is installed on the standard 48.

With reference to FIGS. 12-14 and 14A, when the shelf support 46 is properly installed on the standard 48, each retention member 120 of the shelf support 46 is received at least partially in one of the apertures 88, and the shelf support rear vertical edges 101V (FIG. 13) and 102V (FIGS. 13 and 14) engage and abut the forwardly facing surface of the standard rear wall 60. A forwardly projecting portion of each retention member 120 is received sufficiently forwardly into the receiving notch 88 that the shelf support 46 is supported and can sustain a downward load (as applied by the shelf 42 illustrated in FIGS. 14 and 14A). With reference to FIGS. 14 and 14A, a clockwise torque generated by the weight of the shelf 42 on the shelf support 46 is opposed by the engagement of the standard rear wall 60 with the shelf support rear vertical edges (102V in FIG. 14 and 101V in FIG. 13). The shelving system can be fixed or locked in place by fastening the shelf 42 to the shelf support 46 (such as with screws 55 (illustrated in FIG. 2) that are screwed into the bottom of the shelf 42 through the shelf support apertures 106 (FIG. 10) with the head of each screw 55 engaging the bottom exterior surface of the web 104 of the shelf support 46 (FIG. 2)). With the shelf 42 fixed to the shelf support 46, it is not possible to move the shelf support 46 up or down in the standard 48.

Figure 15:
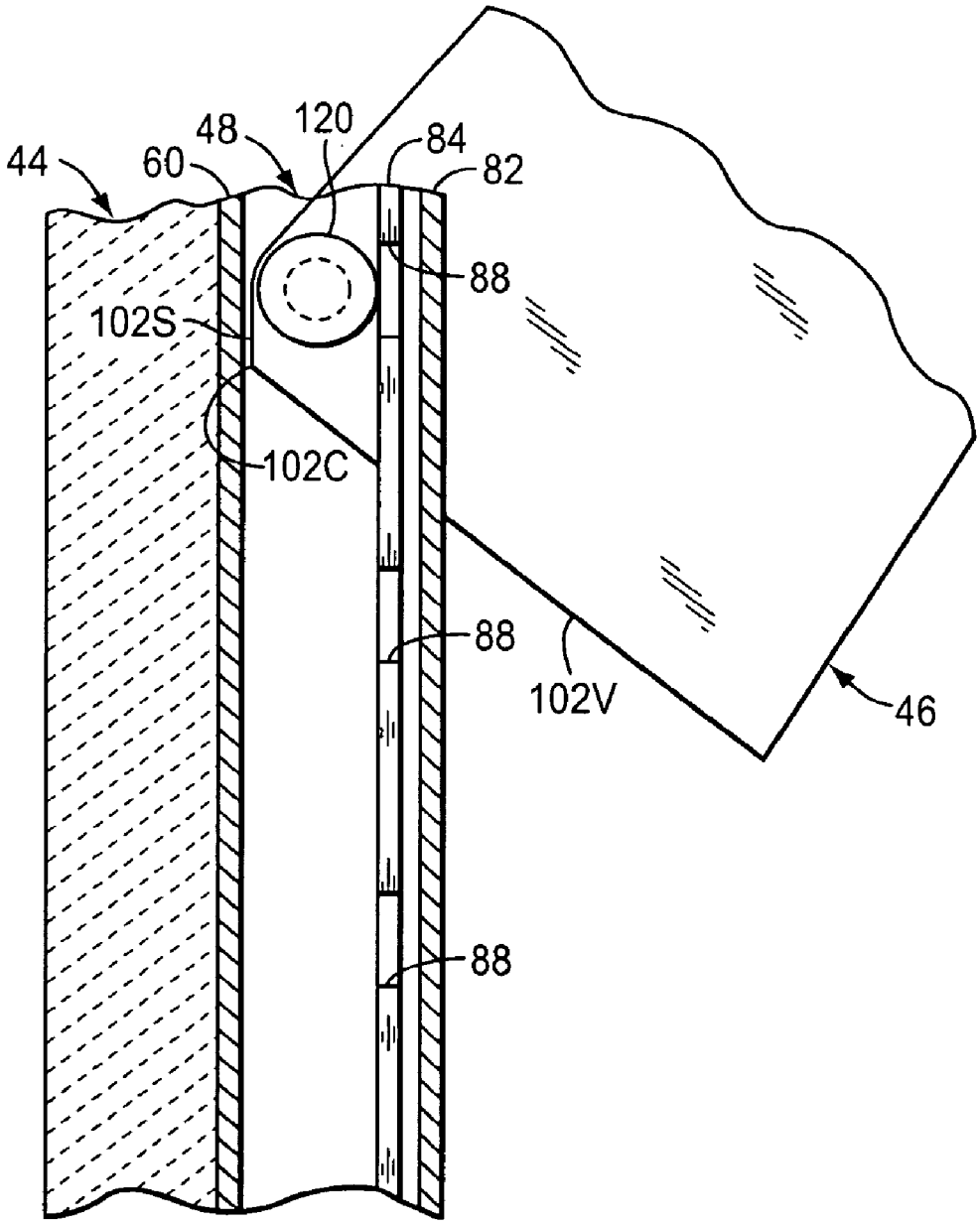
FIG. 15 is a fragmentary, cross-sectional view similar to FIG. 14, but in FIG. 15 the shelf has been removed from the shelf support, and the front of the shelf support has been pivoted upwardly to orient the shelf support for removal or adjustment.

The shelf support 46 can be adjusted within the standard 48 by removing the shelf 42, and then tilting the shelf support 46 upwardly as shown in FIG. 15. This carries the retention members 120 rearwardly out of the respectively notches 88. The upward tilting of the shelf support 46 is accommodated by pivoting the rear of the shelf support 46 about the upper corners 102C (FIG. 15) and 101C (FIG. 10) against the standard rear wall 60. The upward tilting of the shelf support 46 is further accommodated by the recesses defined above the slanting surfaces 1015 (FIG. 10) and 102S (FIG. 15) above the rear corners 102C and 101C, respectively.

When the shelf support 46 is in the upwardly tilted position as shown in FIG. 15, the shelf support 46 can be moved upwardly or downwardly within the standard 48. Indeed, the shelf support 46 can be completely removed from the standard 48 by maintaining the tilted orientation of the shelf support 46, and then lifting the shelf support 46 upwardly completely out of the top of the standard 48 (or, alternatively, by lowering the tilted shelf support 46 downwardly completely below the bottom of the standard 48.

To initially install the shelf support system on a vertical surface 44, one or more standards 48 are attached vertically to the wall or other vertical surface 44, and then one or more shelf supports 46 are oriented at the angle shown in FIG. 15 for accommodating insertion into the open top end of the standard 48 or into the open bottom end of the standard 48. The tilted shelf support or shelf supports 46 are positioned at the desired elevation in the channel of the standard 48, and then are tilted back to the substantially horizontal position wherein the shelf support retention members 120 are received in adjacent notches 88 to maintain the shelf support 46 in the substantially horizontal orientation for supporting a shelf 42 that can be subsequently disposed upon the shelf support 46.

Because the retention members 120 are spaced apart on opposite sides of the shelf support 46, as illustrated in FIG. 10, the shelf support 46, when properly installed on the standard 48 (as in FIG. 2), is relatively stable. Of course, when a shelf 42 is placed on such a shelf support 46 and secured thereto, movement of the shelf 42 and shelf support 46 from a horizontal position is not possible. Further, if two, spaced-apart, vertical standards 48 are provided on a vertical surface 44, and if each vertical standard 48 supports at least one shelf support 46 with a single shelf 42 spanning the two shelf supports 46, then such a shelving system provides even greater rigidity and stability. It is contemplated that the typical arrangement of the mounting system of the present invention would include at least two spaced-apart standards 48, each with a separate shelf support 46 for supporting one shelf 42 spanning the shelf supports 46. However, for a very short shelf 42, only one standard 48 might be sufficient, and for a very long shelf 42, more than two standards 48 may be needed.

In a modification of the shelf support 46 of the system of the present invention (which modification is not illustrated), the shelf support 46 may be provided as a single, unitary, planar member instead of a pair of spaced-apart legs connected by a bottom web. Such a single, planar member can be provided with a pair of retention members, such as the retention members 120 illustrated in FIGS. 10-15. Such retention members could be affixed to either side of a single, planar shelf support, or could be provided on a shaft disposed through a suitable receiving aperture in such a planar shelf support.

The shelf support system of the present invention could be further modified (not illustrated) so that the single shank 124 on each shelf support (similar to shelf support 46) is replaced by two, separate, shorter shanks that are laterally projecting but vertically offset, and that each carries one retention member (similar to retention member 120). That is, in such a modification, one shank and one attached retention member are located at one vertical elevation projecting laterally from one side of the rear portion of the shelf support, and the second shank and attached retention member are vertically offset at a different vertical elevation and project laterally from the other side of the rear portion of the shelf support—so long as the two retention members are vertically offset in positions so as to each be received in a notch (similar to the notch 88) when the shelf support is installed in the standard. Also, in a further modification employing such vertically offset retention members, the notches in each mounting wall (similar to notches 88 in mounting walls 71 and 72) could be located so that the notches in one mounting wall are vertically offset with respect to the notches in the other mounting wall.

In still another modification, the shelf support (such as shelf support 46) can have only one retention member (such as retention member 120) projecting laterally to engage a notch (such as one of the notches 88) in one of the standard's mounting walls (such as mounting wall 71 or mounting wall 72). Indeed, in such a modification, notches are needed in only one of the standard's mounting walls (e.g., mounting wall 71 or mounting wall 72). The standard's mounting walls can be spaced sufficiently close together on each side of the installed shelf support to prevent the shelf support from moving or twisting out of engagement under load.

It will be readily apparent from the foregoing detailed description of the invention and from the illustrations thereof that numerous variations and modifications may be effected without departing from the true spirit and scope of the novel concepts or principles of this invention.

What is claimed is:

1. A standard and shelf support for use in supporting a shelf from a generally vertical surface, the standard and shelf support comprising:

a standard having a rear wall configured to be connected to a generally vertical surface and first and second mounting walls being spaced apart and extending from said rear wall, wherein said first and second mounting walls define a channel that is open at the front of said standard and at least one of said first and second mounting walls defines a plurality of spaced apart notches that are open at least rearwardly toward said rear wall and that are hidden from view when said standard is viewed directly from the front of said standard;

a shelf support having an attachment portion located at one end of said shelf support and having at least one retention member that is located forward of a rear abutment, wherein when said shelf support is in an installed position on said standard for use in supporting a shelf said attachment portion is received within said channel, said at least one retention member is at least partially received in at least one of said notches, and said rear abutment engages said rear wall and prevents rearward movement of said shelf support and removal of said at least one retention member from said at least one of said notches; and wherein when said at least one retention member is to be removed from said at least one of said notches said rear abutment remains engaged with said rear wall while said shelf support is pivoted about an upper portion of said rear abutment such that said at least one retention member is carried rearwardly out of said at least one of said notches.

2. The standard and shelf support in accordance with claim 1 wherein each of said first mounting wall and said second mounting wall defines a plurality of spaced apart notches that are each open at least rearwardly toward said rear wall.

3. The standard and shelf support in accordance with claim 1 wherein said shelf support further comprises a shelf support platform upon which at least a portion of a shelf can be disposed.

4. The standard and shelf support in accordance with claim 3 wherein said shelf support platform further comprises a generally U-shaped, transverse cross section defined by first and second spaced apart legs which are joined by a connecting web.

5. The system in accordance with claim 4 wherein said shelf support platform first and second spaced apart legs extend rearwardly to define at least a portion of said attachment portion.

6. The standard and shelf support in accordance with claim 1 wherein said shelf support attachment portion further comprises a pair of spaced apart retention members.

7. The standard and shelf support in accordance with claim 6 wherein one retention member of said pair is configured to be received in one of the plurality of spaced apart notches defined in said first mounting wall and the other retention member of said pair is configured to be received in one of the plurality of spaced apart notches defined in said second mounting wall.

8. The standard and shelf support in accordance with claim 1 wherein said rear abutment of said attachment portion of said shelf support further comprises an upper corner.

9. The standard and shelf support in accordance with claim 8 wherein said rear abutment further comprises a recess that is located rearwardly of said retention members.

10. The system in accordance with claim 1 wherein said shelf support attachment portion further comprises at least one elongate shank oriented parallel to said rear wall of said standard when said shelf support is installed on said standard.

11. The system in accordance with claim 1 wherein said standard rear wall defines at least one aperture for receiving a fastener for attaching said standard to a vertical surface.

12. A system for mounting one or more shelves to a generally vertical surface, said system comprising:

at least one standard having a rear wall configured to be connected to a generally vertical surface and first and second mounting walls being spaced apart and extending from said rear wall, wherein said first and second mounting walls define a channel that is open at the front of said standard providing access to said rear wall, and at least one of said first and second mounting walls defines a plurality of spaced apart notches that are open at least rearwardly toward said rear wall and that are hidden from view when said standard is viewed directly from the front of said standard; and at least one shelf support upon which at least a portion of a shelf can be disposed, said shelf support having an attachment portion located at one end of said shelf support and being configured to fit within said channel, said attachment portion comprising at least one retention member and a rear abutment positioned rearward thereof, wherein when said shelf support is installed on said standard for use in supporting a shelf, said rear abutment engages said rear wall and said at least one retention member is at least partially received in said at least one of said notches, and wherein when said shelf support is to be repositioned along said standard said rear abutment remains engaged with said rear wall while said shelf support is pivoted about an upper portion of said rear abutment which carries said at least one retention member out of said at least one of said notches.

13. The system in accordance with claim 12 wherein the at least one shelf support further comprises a shelf support platform upon which at least a portion of a shelf can be disposed.

14. The system in accordance with claim 12 wherein rear abutment of said attachment portion of the at least one shelf support further comprises an upper corner.

15. The system in accordance with claim 12 wherein said rear abutment of said attachment portion of the at least one shelf support further comprises a recess that is located rearwardly of said at least one retention member.

16. The system in accordance with claim 15 wherein said recess is located above said upper corner of said rear abutment.

17. The system in accordance with claim 12 wherein the attachment portion of the at least one shelf support further comprises at least one leg extending rearwardly.

18. The system in accordance with claim 12 wherein the attachment portion of the at least one shelf support further comprises at least one elongate shank oriented parallel to said rear wall of said standard when said shelf support is installed on said standard.

19. The system in accordance with claim 18 wherein said at least one elongate shank further comprises two laterally extending ends.

20. The system in accordance with claim 19 wherein said at least one retention member further comprises a disk located on one of the respective laterally extending ends of said at least one elongate shank.

* * * * *